United States Patent [19]

Sasaki et al.

[11] 4,370,102

[45] Jan. 25, 1983

[54] FLUID PUMPING DEVICE

[75] Inventors: Michiaki Sasaki, Yokohama; Kiyokazu Yamamoto; Ko Hiratsuka, both of Fujisawa, all of Japan

[73] Assignees: Nissan Motor Company, Limited; Jidosha Denki Kogyo Kabushiki Kaisha, both of Yokohama, Japan

[21] Appl. No.: 227,638

[22] Filed: Jan. 23, 1981

[30] Foreign Application Priority Data

Jan. 31, 1980 [JP] Japan ..... 55-10687[U]

[51] Int. Cl.[3] ..... F04B 49/02; F04B 47/08

[52] U.S. Cl. ..... 417/296; 137/506; 137/510; 137/512.2; 417/366

[58] Field of Search ..... 137/506, 510, 512.2; 417/296, 307

[56] References Cited

U.S. PATENT DOCUMENTS

| | | | |
|---|---|---|---|
| 1,885,000 | 10/1932 | Muller | 137/510 |
| 2,603,231 | 7/1952 | Birkemeier | 137/510 |
| 4,336,002 | 6/1982 | Rose et al. | 417/366 |

FOREIGN PATENT DOCUMENTS

| | | | |
|---|---|---|---|
| 1202545 | 10/1965 | Fed. Rep. of Germany | 417/296 |

*Primary Examiner*—Richard E. Gluck
*Assistant Examiner*—Jane E. Obee
*Attorney, Agent, or Firm*—Lane, Aitken, Kice & Kananen

[57] ABSTRACT

A device for pumping fluid includes a main pump device and an auxiliary device integrally fixed thereto. The auxiliary device can function as a damper, cut-off valve, check valve and relief valve. The auxiliary device includes a first and second room separated by a diaphragm. The first room is connected to the fuel supply passage of the main pump device. One end of the outlet passage of the auxiliary device is connected to the first room by way of a valve mechanism consisting of a valve body and valve seat. The valve body is actuated by deforming of the diaphragm in response to the change of the fluid pressure within the first room. A relief passage is formed in the valve body to connect the first room with the second room. A relief valve such as a ball valve is placed in cooperation with the relief passage.

4 Claims, 6 Drawing Figures

FLUID PUMPING DEVICE

BACKGROUND OF THE INVENTION

The present invention relates to a device for pumping fluid and in particular relates to a fuel pump for an automotive vehicle equipped with a fuel injection type internal combustion engine.

In general, a fuel supply system of an automotive vehicle includes a damper, check valve and cut-off valve for the purpose of modulating pulsation of the fuel supplied from a fuel pump and a relief valve for the purpose of keeping the fuel pump from building up too much pressure. In a prior art fuel supply system, the damper is placed in an oil line downstream of the fuel pump, the relief valve is positioned within the fuel pump, and the check valve and the cut-off valve are provided at the outlet of the fuel pump. Thus, those elements are separate.

Such a separate arrangement of the damper, check valve, cut-off valve, relief valve and others requires a lot of arrangement space for each element. In addition, it is sometimes difficult that all of those elements perfectly function as desired.

SUMMARY OF THE INVENTION

According to the present invention, a device for pumping a fuel or other fluid includes a single auxiliary device functioning as a damper, check valve, cut-off valve and relief valve by uniting those. The auxiliary device is integrally provided to a fuel pump.

Therefore, it is an object of the present invention to provide a device for pumping fluid which requires only a small space for arranging an auxiliary device functioning as a damper, check valve, cut-off valve and relief valve.

Another object of the present invention is to provide a fuel pump for an automotive vehicle equipped with a fuel injection type internal combustion engine, including an auxiliary device which can modulate pulsation of the fuel fed from the fuel pump and keep the fuel pump from building up too much pressure.

BRIEF DESCRIPTION OF THE DRAWINGS

These and other objects, features and advantages of the present invention will become more apparent from the following description of a preferred embodiment thereof when taken in conjunction with the accompanying drawings, in which.

DETAILED DESCRIPTION OF THE PREFERRED EMBODIMENT

Figure 1:
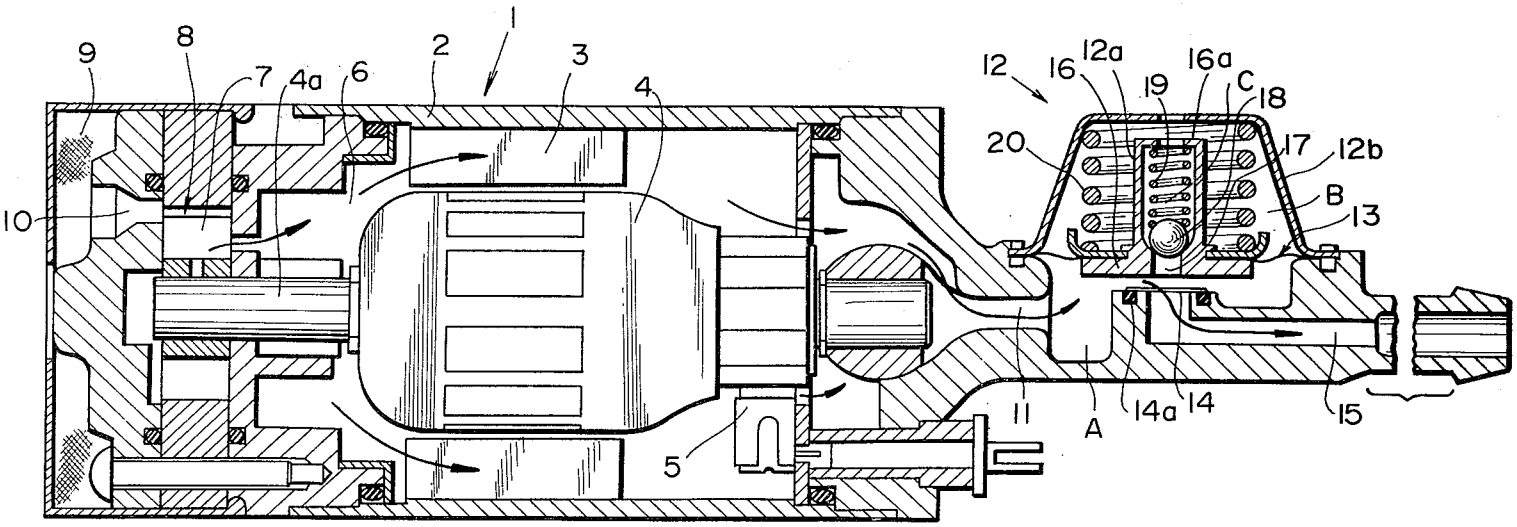
FIG. 1 shows a vertical section of a device for pumping fuel according to the present invention, with some parts thereof being omitted.

Referring now to FIG. 1, a fuel pump 1 includes a casing or yoke 2, a magnet 3 fixed thereto, an armature 4, a brush 5 and others placed in an electric motor room 6 and a runner 7 attached to a shaft 4*a* of the armature 4 and rotatably placed within a pump room 8 in a conventional manner. When the shaft 4*a* of the armature 4 rotates, the runner 7 is actuated to rotate so that the fuel is taken into an inlet 10 of the pump 1 by way of a filter 9 and supplied at a predetermined pressure into the electric motor room 6. The fuel passes the electric motor room 6 and flows through a connecting passage 11 positioned at the front end of the fuel pump 1.

An auxiliary device 12 is integrally fixed to the main pump 1 at the connection passage 11.

The auxiliary device 12 includes a first room A and a second room B which are separated by a diaphragm 13. The first room A is formed in the lower portion of the auxiliary device 12 and directly connected to the outer end of the connecting passage 11 of the main pump 1. A valve seat 14 is formed on the center of the bottom of the first room A. A sealing ring 14*a* is attached to the valve seat 14. An outlet passage 15 is formed in the bottom portion of the auxiliary device 12 in such a manner that it can be arranged substantially in its radial direction. The inner end of the outlet passage 15 is opened to connect with the center of the first room A at the valve seat 14. The outer end of the outlet passage 15 is to communicate with an oil line or fuel supply pipe (not shown) leading to an internal combustion engine.

A valve body 16 is fixed to the inner periphery of the diaphragm 13 at the central portion thereof to face the valve seat 14. The valve body 16 can move vertically and the bottom surface of the valve body 16 is adapted to contact the upper surface of the valve seat 14 so as to close the inner open end of the outlet passage 15 of the auxiliary device 12. Also, the fuel flow rate can be adjusted by changing the relative distance between the valve body 16 and the valve seat 14.

A relief passage 17 is formed vertically at the very center of the valve body 16 so as to correspond to the inner open end of the outlet passage 15 of the auxiliary device 12. The relief passage 17 is opened at its lower end to the first room A and at its upper end to a third room C defined by a cylindrical casing 12*a*. The cylindrical casing 12*a* is formed integral with the valve body 16. A ball type relief valve 18 is arranged within the third room C and biased by a coil spring 19 toward the relief passage 17 to close the upper open end thereof. The third room C is to communicate with a fuel tank (not shown) through the second room B.

The second room B is defined by a truncated cone shape of casing 12*b*, a portion of the valve body 16 and the diaphragm 13. A large coil spring 20 is provided between the valve body 16 and the upper wall of the truncated cone casing 12*b* so as to bias the valve body 16 and the diaphragm 13 in such a direction that the valve body 16 moves toward the valve seat 14.

Figure 2A:
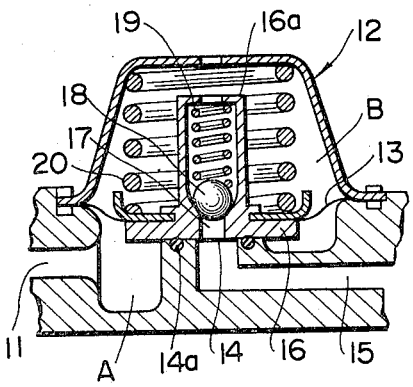
FIGS. 2A through 2E show different operation modes of an auxiliary device constituting a part of the fuel pumping device shown in FIG. 1, respectively.

In operation, when the fuel supply pressure of the pump 1 is zero, that is, when the pump 1 stops, as shown in FIG. 2A, the spring 20 urges the valve body 16 to contact the valve seat 14 by its biasing force. Also, the relief valve 18 is closed by the biasing force of the spring 19.

Figure 2B:
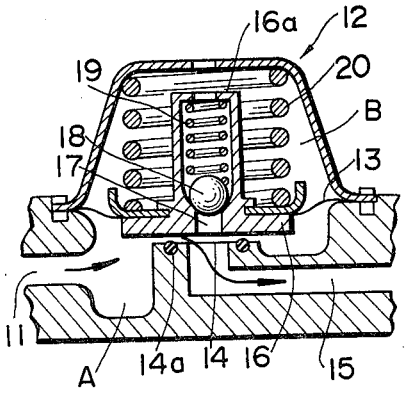

When the pump 1 starts, the fuel pressure increases in the passage 11. As a result, as shown in FIG. 2B, the diaphragm 13 deforms upwardly to some extent by means of the fuel pressure so that the valve body 16 departs slightly from the valve seat 14 against the biasing force of the spring 20 whereby a small amount of fuel can flow into the outlet passage 15.

In this case, the valve body 16 supported by the diaphragm 13 functions as a cut-off valve for preventing the fuel pressure from dropping.

Figure 2C:
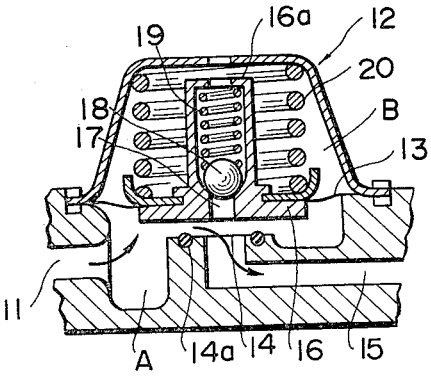

When the pressure of the fuel pump 1 reaches a preset value, as shown in FIG. 2C, the diaphragm 13 and the valve body 16 become balanced with the spring 20 so that the valve body 16 stops. The fuel is fed at a predetermined pressure into the outlet passage 15. The pulsation of the fuel can be absorbed as a result that the diaphragm 13 moves upwardly or downwardly from the stop point thereof.

In this case, the diaphragm 13 and the valve body 16 supported thereby function as a damper.

If the fuel pump 1 stops in such a case, the pressure within the first room A decreases. Thus, the diaphragm 13 deforms downwardly by the biasing force of the spring 20 so that the valve body 16 contacts the valve seat 14. Consequently, the valve body 16 comes back to the position shown in FIG. 2A and the fuel pressure within the fuel supply pipe downstream of the outlet passage 15 can be maintained at a predetermined value.

In this case, the valve body 16 functions as a check valve.

Figure 2D:
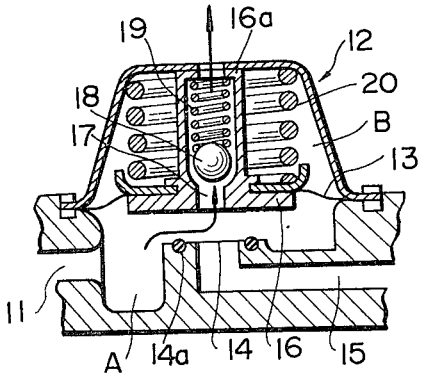

During the normal operation of the pump 1, if an accident occurs in the fuel supply pipe, for instance, due to a collision so that the fuel pressure at the side of the fuel pump 1 excessively increases, then a stop portion 16*a* at the upper end of the first casing 12*a* contacts the upper wall of the second room B as shown in FIG. 2D. Further, the relief valve 18 opens against the biasing force of the spring 19 by the fuel pressure within the first room A. As a result, the fuel can flow by way of the relief valve 18 into the second room B and then a fuel tank (not shown).

Figure 2E:
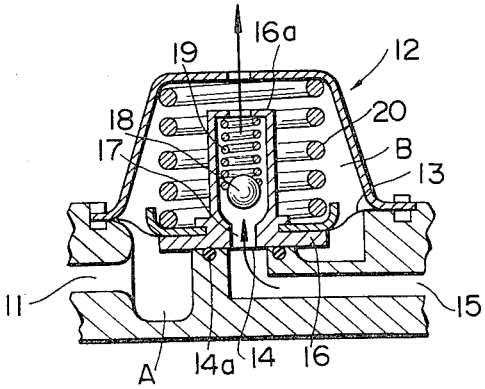

If the fuel pressure within the fuel supply pipe downstream of the passage 15 excessively increases due to the temperature increase thereof, for example, as shown in FIG. 2E, the relief valve 18 opens so that the fuel within the passage 15 can flow through the second room B into the tank.

In this case, the relief valve 18 functions as a safety valve for protecting the fuel lines.

In addition, whenever the fuel pump 1 stops, the valve body 16 can contact the valve seat 14 under pressure so that the outlet passage 15 is closed. Therefore, for instance, even if a fuel line is broken, it is required merely to stop the fuel pump 1 for the purpose of preventing a big accident from occurring, because the fuel within the tank cannot flow out.

According to the present invention, a single auxiliary device can function as a damper, cut-off valve, check valve and relief valve, which is integrally provided onto a fuel pump. Thus, a lot of arrangement space for those parts and assembling time thereof can be remarkably decreased. In addition, as several functions can be advantageously united at one place, each function can be perfectly accomplished. Also a fluid pumping device according to the present invention is simple in construction and easy to operate. Those and other practical remarkable advantages can be obtained.

Although a preferred embodiment of the present invention has been shown and described, it is only illustrative and not restrictive. For example, the present invention can be applied to not only a fuel pump for an automotive vehicle but also any type fluid pumping device.

What is claimed is:

1. A device for pumping fluid, including a main fluid pump device and an auxiliary device, the main pump device having a fluid intake passage and a fluid supply passage, the auxiliary device being fixed at the side of the fluid supply passage, the auxiliary device comprising:

a first room communicating with the fluid supply passage of the main pump device;

a second room;

a diaphragm for separating the first room from the second room in such a way that the diaphragm can be actuated in response to the change of the fluid pressure within the first room;

a valve seat formed in the first room;

a first spring;

a valve body attached to the diaphragm and biased by the first spring toward the valve seat so that the valve body can move against the biasing force of the first spring to depart from the valve seat when the fluid pressure in the first room increases although the valve body contacts normally the valve seat due to the biasing force of the first spring;

an outlet passage having one end which is opened to the first room and regulated by the valve body in cooperation with the valve seat so that the fluid flow can be modulated from the first room into the outlet passage;

a relief passage formed in the valve body to be connected at its one end to the first room and at its other end to the second room;

a relief valve for controlling the relief passage; and a second spring for biasing the relief valve toward the relief passage so as to close the relief passage due to the biasing force of the second spring, whereby the auxiliary device can function as a damper, cut-off valve, check valve and relief valve.

2. A device for pumping fluid as defined in claim 1, wherein the main pump and the auxiliary device are integrally formed.

3. A device for pumping fluid as defined in claim 1 or 2, wherein the main pump device is applied to an automotive vehicle equipped with a fuel injection type internal combustion engine.

4. A device for pumping fluid as defined in claim 1 or 2, wherein the relief valve is a ball type valve.

* * * * *